US005315850A

United States Patent [19]

Edeus et al.

[11] Patent Number: 5,315,850

[45] Date of Patent: May 31, 1994

[54] SURFACE MOUNTED SLIDE BOLT

[75] Inventors: James A. Edeus, Rock Falls; Timothy J. Powell, Sterling, both of Ill.

[73] Assignee: National Manufacturing Company, Sterling, Ill.

[21] Appl. No.: 35,977

[22] Filed: Mar. 22, 1993

[51] Int. Cl.[5] ..... E05B 9/04

[52] U.S. Cl. ..... 70/129; 70/369; 70/371; 70/451; 70/466; 292/153; 292/337; 292/DIG. 53

[58] Field of Search ..... 70/375, 369, 371, 448, 70/451, DIG. 6, DIG. 26, DIG. 57, 129, 466; 292/153, 337, DIG. 51, DIG. 53, DIG. 64

[56] References Cited

U.S. PATENT DOCUMENTS

| | | | |
|---|---|---|---|
| 67,549 | 8/1867 | Hunter . | |
| 184,184 | 11/1876 | Steele . | |
| 310,787 | 1/1885 | Buckley et al. . | |
| 414,570 | 11/1889 | Park . | |
| 611,941 | 10/1898 | Robertson . | |
| 838,644 | 12/1906 | Rapson . | |
| 1,357,122 | 10/1920 | Schroeder | 70/451 |
| 1,364,749 | 1/1921 | Graybeal . | |
| 1,621,934 | 3/1927 | Kintner . | |
| 2,103,989 | 12/1937 | Machinist | 70/DIG. 57 X |
| 2,468,406 | 4/1949 | Mora | 292/153 X |
| 2,701,734 | 2/1955 | Grossman | 70/DIG. 57 X |
| 3,599,453 | 8/1971 | Bauernfeind | 70/129 |
| 3,606,775 | 9/1971 | Atkins . | |
| 3,971,239 | 7/1976 | Lavis | 292/337 X |
| 4,185,860 | 1/1980 | Bondi | 292/148 |
| 4,227,386 | 10/1980 | Crockett | 70/118 |
| 4,545,225 | 10/1985 | Mihojevich | 292/153 X |
| 4,641,506 | 2/1987 | Boucher | 70/129 |
| 4,673,202 | 6/1987 | Willis | 292/162 |
| 4,724,690 | 2/1988 | Dunphy et al. | 70/129 |
| 4,746,152 | 5/1988 | Willcox | 292/150 |

*Primary Examiner*—Lloyd A. Gall

*Attorney, Agent, or Firm*—Tilton, Fallon, Lungmus & Chestnut

[57] ABSTRACT

A surface mounted slide bolt including a base, a strike, a bolt and a plug for locking the bolt in either extended or retracted positions and for disposing the bolt in position relative to the base for assembly and disassembly. The bolt includes tongues receivable in notches of L-shaped flanges of the base.

17 Claims, 3 Drawing Sheets

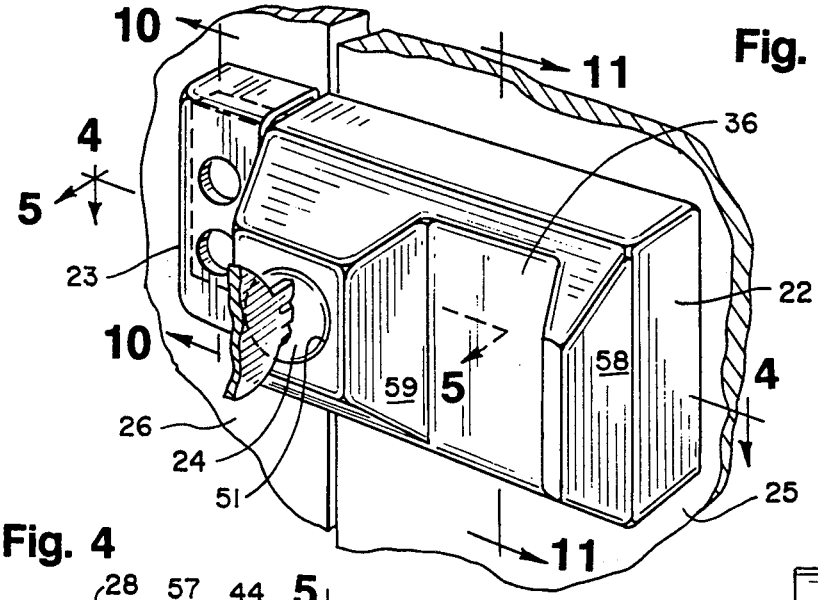
Fig. 3
Fig. 4
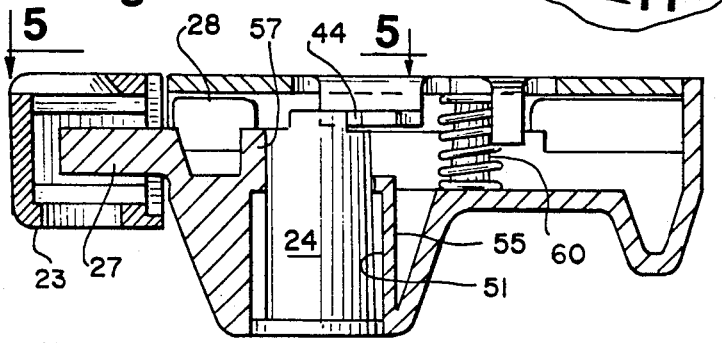
Fig. 5
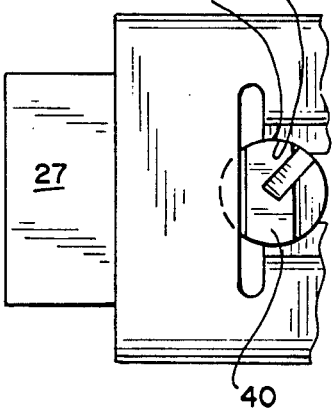
Fig. 6
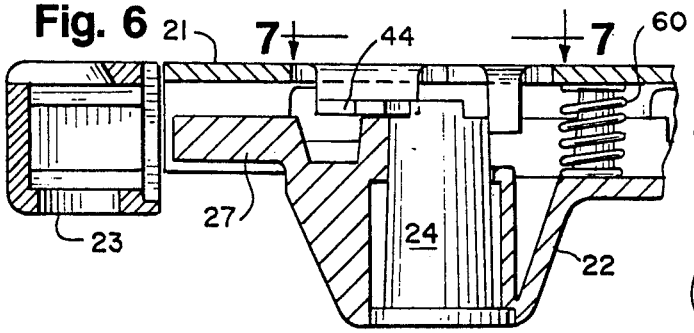
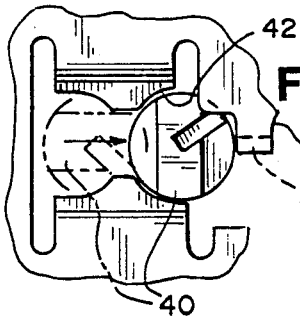
Fig. 7
Fig. 8
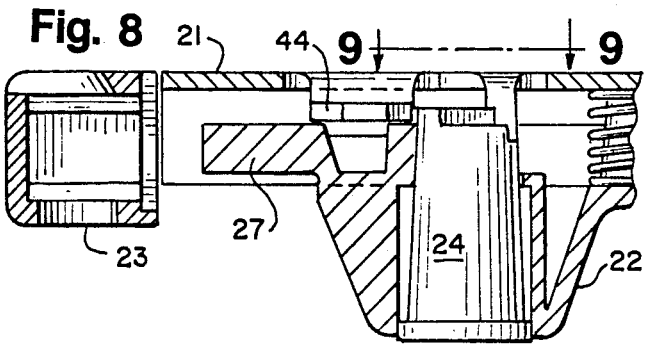
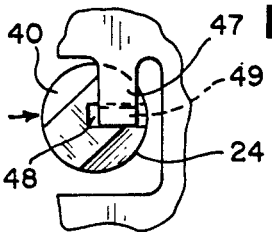
Fig. 9

Fig. 10
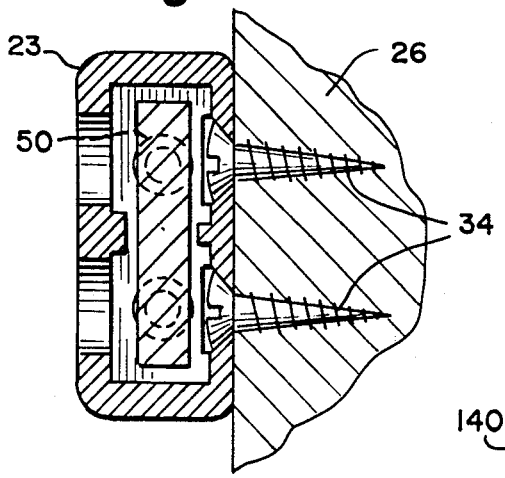
Fig. 11
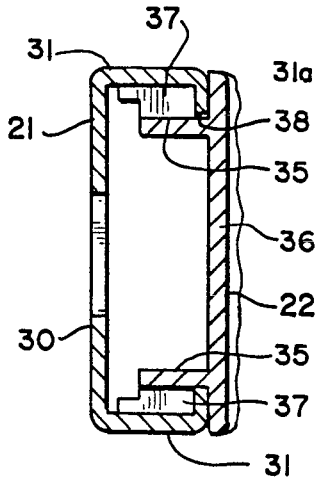
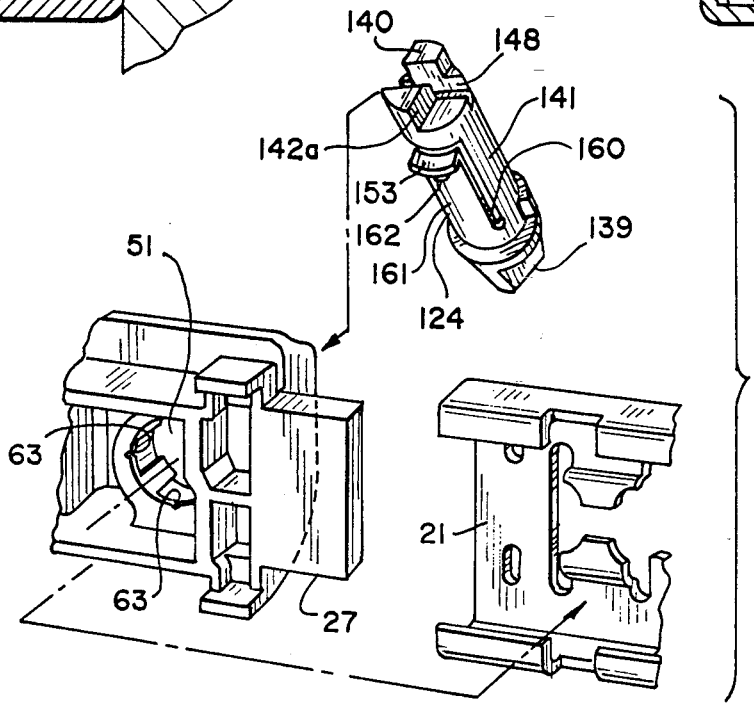
Fig. 12
Fig. 13
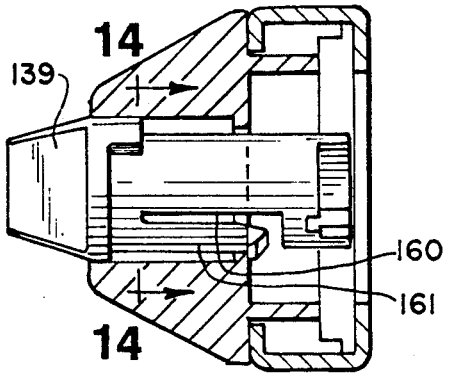
Fig. 14
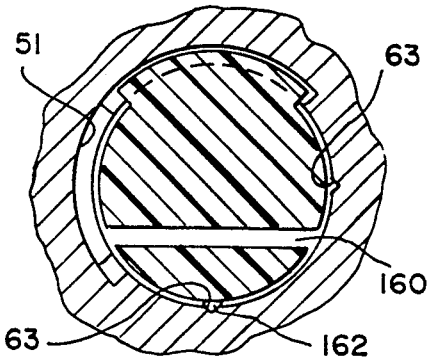

SURFACE MOUNTED SLIDE BOLT

BACKGROUND AND SUMMARY OF INVENTION

This invention relates to a surface mounted slide bolt and, more particularly, to a bolt mountable on a door, window, drawer, etc.

Slide bolts have been known and used for a long time but notwithstanding this, improvements are being made continually. Among the features which have been utilized for the last quarter-century or so are the use of key-equipped locks and also the arrangement whereby the fastening screws are covered both in the extended and retracted positions of the slide bolt. Exemplary or such is Pat. No. 3,606,775.

Notwithstanding such developments, there are advantages that have not been fully realized such as fewer part design, simplicity of assembly, avoidance of load on the lock elements and versatility of the construction to afford operation without the lock. These and other advantages are achieved according to the invention wherein we provide four basic elements, viz., a relatively elongated base and a strike, both of which are adapted to be mounted on door means such as the door and frame of a doorway, window and window frame, drawer and case and the like. The other two members include a relatively elongated bolt slidably and removably mounted on the base and having a passage means intermediate the ends and plug means mounted in the passage of the bolt.

The plug means and the base have cooperating portions for placing the bolt in three positions relative to the base. The fully retracted position permits disassembly, the fully extended position has the bolt lockingly engaging the strike and a third is an intermediate position where the bolt is not disassembable from the base but is retracted from the strike so as to position the door, etc. in openable condition.

The invention, in the specific embodiment includes as the plug means a lock or turn knob which is a generally elongated cylindrical member having a boss at the interior end. The boss or projection has a generally rectangular cross-section featuring opposed arcuate sides and opposed planar sides. The planar sides are closer together than the arcuate sides so as to make the boss narrower therebetween than it is 90° therefrom. A turn knob or lock engages tab means upset from the base. When the lock is in its locked position, the lock engages the tab means in the base and prevents the bolt from sliding away from either fully extended or partially retracted positions. By rotating the lock 90°, the boss can pass beyond the tab means allowing the bolt to slide to its opposite position. The base further has a second upset or tab means that acts as a stop limiting the travel of the bolt in its open position. However, the boss has a slot arranged at about 45° so that the bolt can slide further than the unlocked, retracted position by receiving the second tab means. This permits the disassembly of the lock from the bolt and the bolt from the base.

Other objects, advantages and details of construction may be seen in the ensuing specification.

BRIEF DESCRIPTION OF DRAWING

FIG. 3 is a perspective view of the inventive slide bolt shown installed on a door and frame;

FIG. 4 is a sectional view such as would be seen along the sight line 4—4 applied to FIG. 3;

FIG. 5 is a fragmentary rear elevational view such as would be seen along the sight line 5—5 applied to FIG. 4 looking downwardly;

FIG. 6 is a fragmentary sectional view somewhat similar to FIG. 4 but showing the bolt in retracted relation to the strike;

FIG. 7 is a view similar to FIG. 5 but such as would be seen looking downward along line 7—7 of FIG. 6;

FIG. 8 is a view similar to FIGS. 4 and 6 but showing the arrangement of parts in condition for disassembling the slide bolt from the base;

FIG. 9 is a view similar to FIGS. 5 and 7 but such as would be seen looking downwardly along line 9—9 of FIG. 8;

FIG. 10 is a sectional view such as would be seen along the sight line 10—10 applied to FIG. 3; and FIG. 11 is another sectional view such as would be seen along the sight line 11—11 applied to FIGS. 1 and 3;

FIG. 12 is a fragmentary exploded perspective view of a modified form of the invention which differs essentially from that of FIG. 1 in the provision of a different plug means;

FIG. 13 is a sectional view through the assembled base and bolt and features details of the plug means; and FIG. 14 is a sectional view taken along the sight line 14—14 applied to FIG. 13.

DETAILED DESCRIPTION

Figure 1:
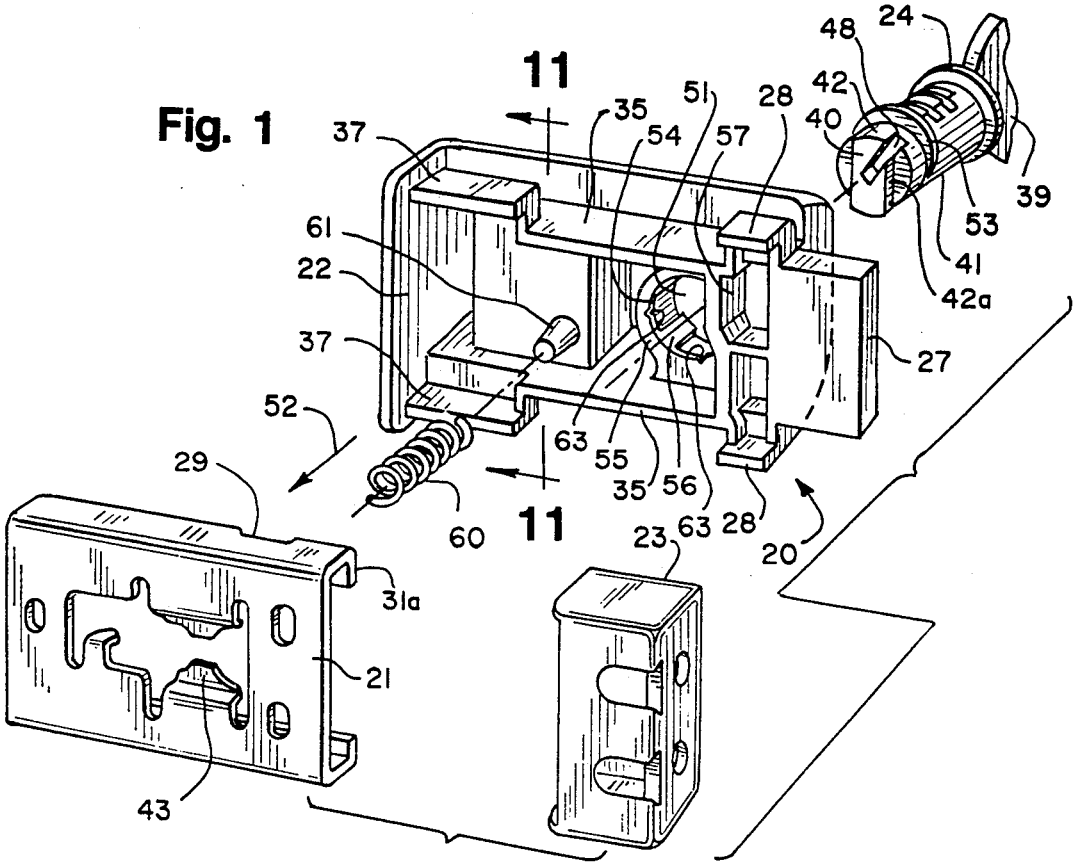
FIG. 1 is an exploded, perspective view of the operational parts of the inventive slide bolt.

In the illustration given and with reference first to FIG. 1, the numeral 20 designates generally the inventive slide bolt assembly. The slide bolt assembly includes a base 21, a bolt 22, a strike 23 and plug means 24. When installed (see FIG. 3) the base is installed against a door 25, for example, and the strike 23 is secured to the door frame 26.

As pointed out previously, the bolt can assume three different positions relative to the base (and therefore the strike). The bolt 22 is equipped with a strike engager or part 27 (compare FIGS. 1 and 4). It will be noted that the bolt 22 is a unitary casting so the strike engager is integral with the remainder of the bolt 22.

In FIGS. 4 and 5 the bolt 22 has been shifted to the left as far as it will go and thus is in a locked position relative to the strike 23. In FIGS. 6 and 7, the bolt 22 has been retracted to the unlock position while in FIGS. 8 and 9 the bolt 22 has been further retracted to the disassembly position, i.e., in the position where the slide bolt 22 can be removed from the base. This is necessary at least during installation where the base 21 has to be mounted first against the designated mounting surface, viz., door, window, dresser drawer, etc. Thereafter, the bolt 22 is installed in the base and for this purpose we provide upper and lower tongues 28 which fit within upper and lower notches 29 (see particularly FIG. 2) in the base 21. More particularly (and referring to FIG. 2), the base 21 is generally C-shaped being equipped with a bight portion 30 integral with longitudinally extending upper and lower L-shaped flanges 31. Each of these L-shaped flanges 31 in its unconnected portion 31*a* is equipped with the notch 29 for the receipt of the post 28 (see FIGS. 1 and 2).

Figure 2:
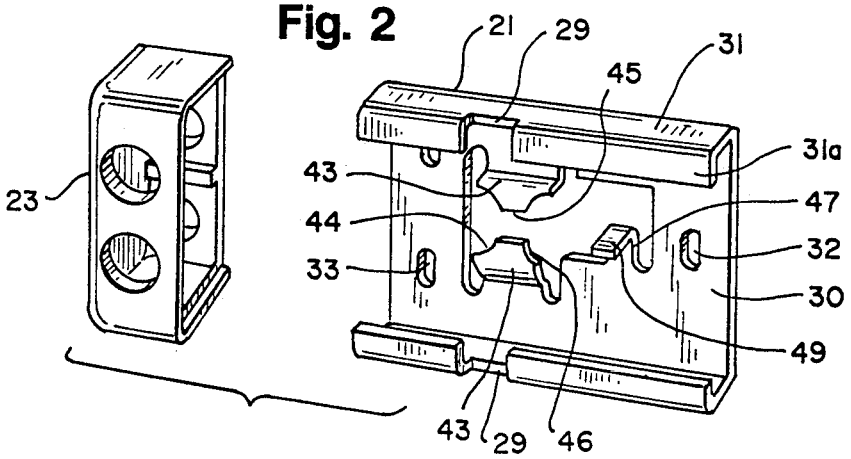
FIG. 2 is an exploded perspective view of the base and strike of the slide bolt of FIG. 1 and constitute the parts that are secured to a structure having a door, window, etc.

So, initially, the base 21 is installed on the door or like structure 25 by installing wood screws (for example) through the opening 32—see the right end of FIG. 2 and the other openings 33—see the left hand end of the base 21. Similarly the strike 23 is installed on the frame 26 by virtue of wood screws 34—see FIG. 10.

Now referring to FIG. 11, the manner in which the bolt 22 is slidably supported on the base 21 will be described. It will be appreciated also that the sectional view seen in FIG. 11 corresponds to that designated in FIG. 1 whereby the section line cuts through a pair of longitudinally extending ribs 35. These are provided integral with the exterior wall 36 of the bolt 22 and provide a support for the tongues 28 (see FIG. 1) and the slot-providing steps 37 (compare the upper and lower portion of FIGS. 1 and 11). It will be noted that the steps 37 are spaced away from the wall 36 so as to define slots 38 (see FIG. 11) wherein the unconnected ends 31*a* of the L-shaped flanges 31 of the base 21 are received. Thus, should the plug means 24 be omitted from the assembly 20, the bolt 22 can slide longitudinally into and out of engagement with the strike 23.

Plug Means

According to the invention, we provide two embodiments of the plug means. The first is shown in FIG. 1 and is a lock plug as at 24 and which features a key 39 (see the upper right hand corner of FIG. 1). The other embodiment is illustrated in FIGS. 12–14 and the plug means there is designated by the numeral 124. This embodiment does not feature a lock but instead has an integral protrusion 139 (see also FIG. 13) to facilitate the rotation of the plug means. However, insofar as providing for three positions of the bolt 22 relative to the strike 23 (and, for that matter, the base 21) the plug means 24, 124 function in the same way. This stems from the fact that the inner end of each of the plug means has an integral boss 40, 140. The boss 40, 140 is developed by removing portions of the generally cylindrical body 41, 141 to develop an essentially zone shape. By zone shape, we refer to the fact that the boss or protrusion 40, 140 is generally rectangular in a vertical plane—see the upper part of FIG. 1. The boss has a pair of parallel generally planar sides 42*a* and a pair of arcuate sides 42. The arcuate sides are designated 42 (see FIG. 5) and are employed in conjunction with upset tab portions 43 in the base 21 (see particularly FIG. 2).

Considering FIGS. 4 and 5 for example, it will be noted that the strike engage portion 27 is extended onto the strike. In this position, the arcuate sides 42 of the boss 40 are in bearing engagement with curved surfaces 44 of the upset portion 43 (see also FIG. 2). At this point in time, the key 39 is positioned vertically as seen in FIG. 1 and so also is the boss 40. The bearing contact of the surfaces or sides 42, 44 prevents movement of the bolt 22 to the right, i.e., out of locking engagement with the strike 23.

To unlock the bolt, the key 39 is turned 90° (to the horizontal) where upon the boss 40 is also horizontally disposed and the planar surfaces 42*a* are able to pass by the spaced apart confronting surfaces 45 in the upset tab portion 43 (again see FIG. 2). Further movement of the bolt 22 to the right—and to the position depicted in FIGS. 6 and 7, permits rotation of the key 39 to the vertical where upon the boss 40 assumes the position seen in FIG. 7. At that point, the arcuate surfaces 42 now abut the other curved surfaces 46 of the upset tab portion 43 (again see FIG. 2) so that movement of the bolt to the left is prevented. Relating the arcuate surfaces 44 and 46 to the strike engager end 27, the surfaces 44 are closer, i.e., proximal surfaces and the surfaces 46 are distal surfaces. We use the terms proximal and distal as relating to the strike 23 or strike engager 27.

Also relative to FIG. 7, it is not possible to move the bolt further to the right because of a second upset portion or means 47 against which the cylindrical body 41 of the plug means 24 bears—see also FIG. 2.

However, when it is desired to disassemble the bolt and base, the key can be turned 45° so as to position the boss 40 in the FIG. 9 orientation. This aligns a slot 48 in the boss with a flange 49 provided as part of the second upset tab portion 47 permitting slight movement of the bolt 22 to the right and to bring the tongues 28 into alignment with the notches 29.

Operation of Embodiment of FIGS. 1–11

The strike 23 is mounted on the door frame 26 or the like by inserting screws as at 34 in FIG. 10. It will be appreciated that a variety of strikes may be employed and may be secured in different fashions. For example, the strike 23 is equipped with additional openings as at 50 (see FIG. 10) which permit side as against end mounting.

Thereafter, or concurrently, the base 21 is mounted on the cooperating element of the structure to be equipped with the slide bolt and for this purpose screws (not shown) are inserted through the openings 32, 33 (see FIG. 2). The base 21 and strike 23 are then arranged relative to each other in the fashion depicted in FIG. 2.

Next, the bolt 22 is installed and the plug means 24 in the form of a key lock may be installed in the passage 51 either before or after the bolt 22 is installed in the base 21. In any event, the bolt 22 is moved in the direction of the arrow 52 (see FIG. i) into nesting relation with the base 21. For this purpose, the tongues 28 are aligned with the notches 29. If the plug means in the form of the key lock 24 has already been installed in the bolt 22, the slot 48 has to be aligned horizontally, i.e., the plug means 24 being in the orientation seen in FIG. 9 wherein the slot 48 is horizontal and the boss 40 is at approximately 45°.

Should the key 39 be removed at this time, the wafer 53 (see the upper right hand portion of FIG. 1) remains engaged with the inner end 54 of the passage-providing generally cylindrical wall 55 (see also FIG. 4) to prevent withdrawal of the cylindrical body 41 of the lock 24. Because of the ribs 56, the key 39 cannot be removed from the lock 24 until the lock 24 is turned from the 45° orientation to a 90°, i.e., with the length of the boss 40 being either horizontal or vertical—the latter being depicted in FIGS. 5 and 7. If the key is removed when the boss is positioned between the surfaces 45, i.e., horizontally, the slide bolt 22 can be moved freely into engaged and retracted positions. If, however, the key is removed with the boss vertically disposed as in FIGS. 5 and 7, the bolt is either fully extended or retracted to the open position.

We have found it advantageous to provide the bolt 22 in the form of an integral, unitary casting and in so doing are able to provide an interior integral wall as at 57 (see FIG. 1) which serves to advantageously stabilize the plug means 24 incident to the various movements of the bolt 22. We provide the wall 57 on the proximal side of the passageway 51 inasmuch as any attempted entry would occur when the bolt is extended, i.e., in the condition of FIGS. 4 and 5. At such a time, any attempt to move the bolt to the right would bring the arcuate surfaces 42, 44 into stronger bearing engagement and any deformation of the lock would be thus resisted by the interior wall 57.

We have found it further advantageous to cast the bolt of metal and provide the external wall 36 with outward projections as at 58 at the distal end and at 59 to provide the passage 51 to receive the plug means 24—see FIG. 3. In contrast, we make the base out of steelplate which, for the smaller sizes, can be 0.060" or so and increasing as the sizes become larger.

This arrangement provides a number of advantages such as the screw fasteners as at 34 and those extending through the openings 32, 33 are covered whether the bolt 22 is either in extended or retracted position. The bolt can be locked in either the extended or retracted position as well with the key removed, the bolt can be either extended or retracted but not locked in either position and it can be used on inward and outwardly opening doors.

As indicated previously, the parts are few and simple but rugged in design. They are easily engaged or disengaged. Because of the interconnection arrangement of the base and bolt, the wafer or wafers of the lock are not stressed when locked in either the extended or retracted position.

Still further, the basic construction of the inventive slide bolt makes it possible for assembly with a non-locking plug means as at 124 as seen in FIGS. 12-14.

Still further there is a simplified arrangement for providing an internal helical spring as at 60 which is mounted on post 61—see FIG. 1. This is mounted as seen readily in FIG. 6 so as to urge the bolt 22 away from the base 21 and thus avoid any unwanted movement stemming from vibration.

Embodiment of FIGS. 12-14

As pointed out previously, the essential difference resides in the plug means 124 which may be readily interchanged with the key lock plug means 24 of the embodiment of FIGS. 1-11. Where it is not desired to have the key lockable feature, the plastic plug 124 may be employed. Thus, instead of the key 39, we provide an integral protuberance 139 (see FIGS. 12 and 13) which is readily graspable between the thumb and forefinger for turning the cylindrical body 141 to various orientations. These orientations are the same as those described previously so as to afford the three positions of the bolt for locking, unlocking and disassembly.

As seen in FIG. 12 there is again a boss 140 which is equipped with a slot 148 extending at 45° to the planar surfaces 142*a*.

Again we provide a passage 51 for the receipt of the plug means 124 and, in the place of the wafer 53 of the lock seen in FIG. 1, we provide an integral flange 153 on the plastic plug member 124. To permit the integral flange 153 to move inwardly so as to move in the passage 51, the plug member 124 is slotted as at 160 to provide a flexing arm portion 161 (see also FIG. 13) which carries at its free end the flange 153.

We also equip the cylindrical body 141 with an integral longitudinally extending rib or detent 162 (see the upper center of FIG. 12 just under the flange 153 and also FIG. 14). This rib is receivable in one of the two generally V-shaped recesses 63 in the passage 51 (compare FIGS. 12 and 14). The combination of the rib 162 and the recesses 63 makes it possible to hold the cylindrical body 141 of the plug member 124 in either the locked or unlocked position—corresponding to the same two positions previously described in conjunction with the embodiment of FIGS. 1-11. For example, where the rib 162 is in the 6 o'clock position and cannot be moved. On the other hand, when the rib 162 is moved from its showing in FIG. 14 to the 3 o'clock position where it engages the corresponding recess 63, the slide bolt is unlocked and can be moved freely.

While in the foregoing specification a detailed description of the invention has been set down for the purpose of illustration, many variations in the details hereingiven may be made by those skilled in the art without departing from the spirit and scope of the invention.

We claim:

1. A surface mounted slide bolt comprising a relatively elongated base and a strike adapted to be mounted on door means, said base being generally C-shaped and having a bight portion integral with longitudinally extending L-shaped flanges, said flanges being equipped with notches at transversely aligned positions, said bight having upset tab portions for cooperating with plug means, a relatively elongated bolt removably mounted on said base and having slot means engaging said L-shaped flanges and tongue means being received in said notches, said bolt being equipped with a passage intermediate the ends thereof and having a strike engager at the end thereof proximal to said strike, plug means removably mounted in said bolt passage and having a surface to cooperate with said bight upset tab portions for placing said bolt in three positions relative to said base wherein a fully retracted position aligns said tongue means and notches for assembly or disassembly of said bolt and base, a fully extended position wherein said engager is received within said strike, and an intermediate position wherein said engager is retracted from said strike.

2. The slide bolt of claim 1 in which said plug means includes a key operated lock.

3. The slide bolt of claim 2 in which said lock is equipped with wafer means and said passage is equipped with wafer engaging means for cooperation with said wafer means to prevent movement of said lock when said key is removed therefrom.

4. The slide bolt of claim 2 in which said lock has an external surface generally flush with an external surface of said bolt, said key serving as a manually graspable handle for turning said plug means for enabling said bolt to move to any of said positions.

5. The slide bolt of claim 1 in which said upset tab portions include a first tab means having a proximal end adjacent said strike and a distal end remote from said strike, each of said proximal and distal ends being equipped with surfaces adapted to engage said plug means, said plug means having a boss adapted in a first orientation of said plug means to engage either of said proximal and distal end surfaces, said first tab means having a third surface intermediate said proximal and distal end surfaces adapted to prevent passage of said plug means therepast when said plug means is in said first orientation but adapted to permit passage therepast when said plug means is in a second orientation.

6. The slide bolt of claim 5 in which said orientations are about 90° apart.

7. The slide bolt of claim 5 in which said boss has a side surface adapted to engage either of said proximal and distal surfaces.

8. The slide bolt of claim 7 in which each of said proximal and distal end surfaces and said boss side surface are generally arcuate.

9. The slide bolt of claim 5 in which said upset tab portions include a second tab means located on the distal side of said first tab means and spaced therefrom to accommodate said plug means therebetween and prevent further distal movement when said boss is in either of the said first or second orientations but to permit further distal movement of said plug means when the same is in a third orientation intermediate said first and second orientations.

10. The slide bolt of claim 9 in which said third orientation is approximately 45° away from each of said first and second orientations.

11. The slide bolt of claim 5 in which said first tab means includes a pair of tabs transversely aligned in said base, said boss being generally rectangular in transverse section and having a pair of generally arcuate opposed side surfaces flanked by a pair of generally planar side surfaces, said planar side surfaces being spaced closer together than said arcuate side surfaces, said tab pair being spaced apart a distance only sufficient to permit passage of said boss when said planar side surfaces are longitudinally aligned therewith.

12. The slide bolt of claim 1 in which said bolt is a cast metal member and equipped with a transverse interior wall adjacent said passage for stabilizing said plug means.

13. The slide bolt of claim 12 in which said wall is on the proximal side of said passage.

14. The slide bolt of claim 1 in which said bolt is equipped with transversely extending post means and spring means mounted on said post means urging said bolt away from said base.

15. The slide bolt of claim 1 in which said plug means is a unitary plastic element.

16. The slide bolt of claim 15 in which said element is equipped with integral finger manipulatable means at one end and boss means at the other end, said boss means being adapted to engage said upset tab portions.

17. The slide bolt of claim 16 in which said element is equipped with a resilient longitudinally extending arm said arm having a free end equipped with a flange for engaging an interior surface of said bolt to avoid inadvertent removal of said element.

* * * * *